US006865777B2

(12) United States Patent
Comstock

(10) Patent No.: US 6,865,777 B2
(45) Date of Patent: Mar. 15, 2005

(54) UNIVERSALLY ROTATING PIVOTAL INTEGRAL LUGGAGE HANDLE

(76) Inventor: Troy C. Comstock, 31 Trail Edge Cir., Powell, OH (US) 43065

( * ) Notice: Subject to any disclaimer, the term of this patent is extended or adjusted under 35 U.S.C. 154(b) by 54 days.

(21) Appl. No.: 10/613,851

(22) Filed: Jul. 7, 2003

(65) Prior Publication Data

US 2005/0011043 A1 Jan. 20, 2005

(51) Int. Cl.[7] ..... A45C 5/10; B62B 7/00

(52) U.S. Cl. ..... 16/114.1; 16/444; 16/900; 16/446

(58) Field of Search ..... 16/113.1, 114.1, 16/405, 429, 900, 444, 446; 190/115, 116, 18 A; 294/150, 154, 156, 137, 165; 403/113, 145, 146, 154, 157, 158; 280/37, 47.315, 47.371, 355.1

(56) References Cited

U.S. PATENT DOCUMENTS

| | | | | |
|---|---|---|---|---|
| 2,490,947 A | * | 12/1949 | Coffing | 74/547 |
| 3,850,533 A | * | 11/1974 | Thielen | 403/58 |
| 4,050,728 A | * | 9/1977 | Davidson | 294/58 |
| 5,178,244 A | * | 1/1993 | Liang | 190/18 A |
| 5,265,307 A | | 11/1993 | Hull | |
| 5,339,934 A | * | 8/1994 | Liang | 190/18 A |
| 5,464,080 A | | 11/1995 | Liang | |
| 5,547,053 A | * | 8/1996 | Liang | 190/115 |
| 5,878,853 A | | 3/1999 | DeRouen | |
| 5,890,570 A | | 4/1999 | Sadow | |
| 6,470,533 B1 | | 10/2002 | Comstock | |
| 6,651,791 B1 | * | 11/2003 | Nykoluk et al. | 190/18 A |

FOREIGN PATENT DOCUMENTS

| | | | | |
|---|---|---|---|---|
| DE | 2100358 A | * | 1/1971 | B23K/9/16 |

* cited by examiner

*Primary Examiner*—Chuck Y. Mah
(74) *Attorney, Agent, or Firm*—Kremblas, Foster, Phillips & Pollick

(57) ABSTRACT

A universally rotatable pivotal integral luggage handle for use with a piece of luggage having a retractable handle frame is provided. The handle includes a grasping portion and a luggage attachment portion. The grasping portion has a hand contacting portion and a base portion, with the base portion having a center section. The center section has a sidewall and a bottom surface. It has a vertical channel which exits at least from the bottom surface. The luggage attachment portion has an upper portion and a lower portion, with the upper portion having a sidewall and a top surface. The luggage attachment portion has a vertical channel which exits at least from the top surface. The grasping portion and the luggage attachment portion are rotatably connected by fastening means extending vertically through the respective channels. The lower portion has a pair of end portions with a second fastening means projecting horizontally outwardly from each of the end portions, such that the pair of second fastening means are connected to the retractable handle frame.

20 Claims, 5 Drawing Sheets

UNIVERSALLY ROTATING PIVOTAL INTEGRAL LUGGAGE HANDLE

BACKGROUND OF THE INVENTION

1. Field of the Invention

This invention relates generally to luggage handles, and more particularly, to such handles that are used with wheeled luggage which provide enhanced directional control as the luggage is pulled by a person wishing to steer the luggage in a particular direction on an underlying surface.

2. Description of the Related Art

This invention is directed to the providing of a device for use as a universally rotatable and pivotable luggage handle for use with wheeled suitcases. Wheeled articles of luggage are well known in the art. Such cases typically incorporate a retractable handle that when extended can be used to guide or tow the case, the case being provided with ground-engaging wheels to permit it to more easily transverse an underlying surface.

Such wheeled cases, in addition to being provided with wheels, also typically have an extendable handle which can be projected from the luggage for tilting the baggage on its wheels for subsequent pulling. The extendable, retractable handle has a transverse portion for grasp by a hand, such that the closed fingers of the hand about the handle form a fist which faces either forward to rearward with respect to the torso of the individual pulling the luggage.

A person who has done much travel recognizes the difficulties associated with the guiding or towing of luggage, especially pieces of large size. This problem becomes acute when it becomes necessary to change direction. Attempts to address the problem have traditionally taken one of two approaches.

The first approach has been to design a better handle. Hull et al, U.S. Pat. No. 5,265,307, discloses an ergonomic adjustable handle. The handle base may be fixedly secured to a piece of luggage. The actual grasping portion of the handle may then be adjusted relative to the base and then secured in relationship thereto in the supposedly optimal position. However, although ergonomic considerations are addressed, there is no pivoting or rotating of the handle relative to the baggage to which it is attached. DeRouen, U.S. Pat. No. 5,878,853, discloses a luggage pull with various embodiments. The luggage pull is secured to the baggage so that the tubular grasping potion of the handle can be rotated 90 relative to the handle portion on the retractable handle member so as to position the hand grasping the luggage pull in a normal position relative to the torso for pulling the bag by transmitting a pulling force through the luggage pull to the handle portion of the bag itself. Even with existing handles, trying to change direction may necessitate the lifting of the bag off of the ground in order to complete the turn, or result in the bag tipping over due to failure in the making of a sudden, sharp turn.

The other traditional approach to the problem has been to design a better suitcase. Liang, U.S. Pat. No. 5,464,080, discloses a universally pivotable luggage steering apparatus incorporated into the piece of luggage. A ball and socket arrangement located at the base of the luggage is set forth as a solution to the problem. Sadow, U.S. Pat. No. 5,890,570, discloses a wheeled carry-on case. Two embodiments show various placements of the handle, however, while this assists in the forward and backward movement of the luggage, it does not address the pivotal maneuvering of the luggage.

Recently, this inventor was awarded U.S. Pat. No. 6,470,533 for a universally rotating pivotal luggage handle. This particular handle comprises a hand grasp, an intermediate member rotatably secured to the intermediate member, and a strap portion, with the strap portion having fastening means to secure the strap portion to itself. However, this invention must be attached to, and possibly detached so that it is not stolen, from the luggage each time the luggage is used.

It is thus apparent that the need exists for an improved luggage handle for use with wheeled luggage, which handle provides enhanced directional control as the luggage is pulled by person wishing to steer the luggage in a particular direction on an underlying surface, especially when there is a change in direction.

SUMMARY OF THE INVENTION

In accordance with the present invention, there is disclosed a universally rotating pivotable integral luggage handle for use with a piece of luggage to effectuate the easy moving of the luggage. The luggage itself is of the type well known in the art, namely, the type which is equipped with a retractable handle frame which extends from a compartment within the piece of luggage itself.

The handle has a grasping portion and a luggage attachment portion. The grasping portion has a hand contacting portion and a base portion. The base portion has a first leg, a second leg, and a center section, with the center section having a sidewall and a bottom surface. The center section is located between the first and second legs. The center section has a vertical channel which exits at least from the bottom surface.

The luggage attachment portion has an upper portion and a lower portion. The upper portion has a sidewall and a top surface. There is also a vertical channel which extends through at least a part of the luggage attachment portion and which exits at least from the top surface. The grasping portion and the luggage attachment portion are connected by fastening means. The fastening means extend vertically through the respective channels in the center section and the luggage attachment portion. The grasping portion and the luggage attachment portion are rotatably secured together. The lower portion includes a pair of end portions with a second fastening means projecting outwardly from each of the end portions to enable the second pair of fastening means to be pivotally connected to the retractable handle frame.

In one embodiment, the center section has a top surface with the vertical channel exiting from the center section top surface. The luggage attachment portion has a bottom surface, which in one embodiment has the vertical channel exiting therefrom. In one embodiment, the lower portion has a rounded side wall.

The bottom surface of the center section is preferably planar, as is the top surface of the luggage attachment portion, such that they are parallel to one another. They could also be coextensive to one another.

In one embodiment, the lower portion has a first leg and a second leg with each second fastening means projecting horizontally outwardly from a respective leg. Preferably, each of the second fastening means are in the same horizontal plane. In one embodiment, the second fastening means are located above the bottom surface of the luggage attachment portion.

In at least one embodiment of the invention, the center section has a vertical channel extending between and exiting from the bottom surface and the top surface. Also in at least one embodiment of the invention, the pair of second fastening means is connected to and provides for the pivotal connection of the luggage attachment portion to the retractable handle frame. Also in at least one embodiment of the invention, the bottom surface of the grasping portion center section and the luggage attachment portion upper portion top surface are coextensive to one another.

There is also disclosed a universally rotatable pivotal integral luggage handle for use with a piece of luggage having a retractable handle frame, which handle includes a grasping portion and luggage attachment portion. The grasping portion has a hand contacting portion and a base portion. The base portion has a first leg, a second leg and a center section. The center section has a sidewall, a top surface, and a bottom surface, with the center section located between the first and second legs and having a vertical channel extending exiting from the bottom surface.

The luggage attachment portion has an upper portion and a lower portion. The upper portion has a sidewall and a top surface. The luggage attachment portion has a vertical channel exiting at least from the top surface. The grasping portion and the luggage attachment portion connected by fastening means. The fastening means extend vertically through the respective channels in the center section and the luggage attachment portion, so that they are rotatably secured together. The lower portion has a first leg and a second leg, with each leg disposed in a generally horizontal plane, and having a pair of end portions with a second fastening means projecting horizontally outwardly from each of the end portions. The pair of second fastening means are connected to and provide for pivotal connection of the luggage attachment portion to the retractable handle frame.

In one embodiment, each of the second fastening means are in the same horizontal plane. In at least one embodiment the second fastening means are located above the bottom surface of the luggage attachment portion.

There is also disclosed a universally rotating pivotable integral luggage handle for use with a piece of luggage to effectuate the easy moving of the luggage. Once again, the handle has a grasping portion and a luggage attachment portion. The grasping portion has a hand contacting portion and a base portion. The base portion has a first leg, a second leg, and a center section, with the center section having a sidewall and a bottom surface. The center section is located between the first and second legs. In this embodiment, the center section has a vertically disposed fastening means extending downwardly below the bottom surface.

The luggage attachment portion has an upper portion and a lower portion. The upper portion has a sidewall and a top surface. There is also a recess which extends through at least a part of the upper portion of the luggage attachment portion and which has an opening exposed at the top surface to provide access for the fastening means. The grasping portion and the luggage attachment portion are thus rotatably secured together. The lower portion is secured to the luggage handle frame.

The bottom surface of the center section is preferably planar, as is the top surface of the luggage attachment portion, such that they are parallel to one another. They could also be coextensive to one another.

The fastening means may take the form of a ball joint, with the ball joint being spaced a distance below the bottom surface. In this embodiment of the invention, preferably the grasping portion includes a connector between the ball joint and the bottom surface.

The primary objective of this invention is to provide a device to assist in the pulling of luggage, which device can be made integral to the luggage so as to permit the luggage to which it is attached to pivot easily, especially when there is a sudden change of direction.

Another objective of this invention is to provide a device to assist in the pulling of luggage, which device is of relatively economical construction.

Other objects and advantages of the invention will be apparent from the following description, the accompanying drawings and the appended claims.

Figure 1:
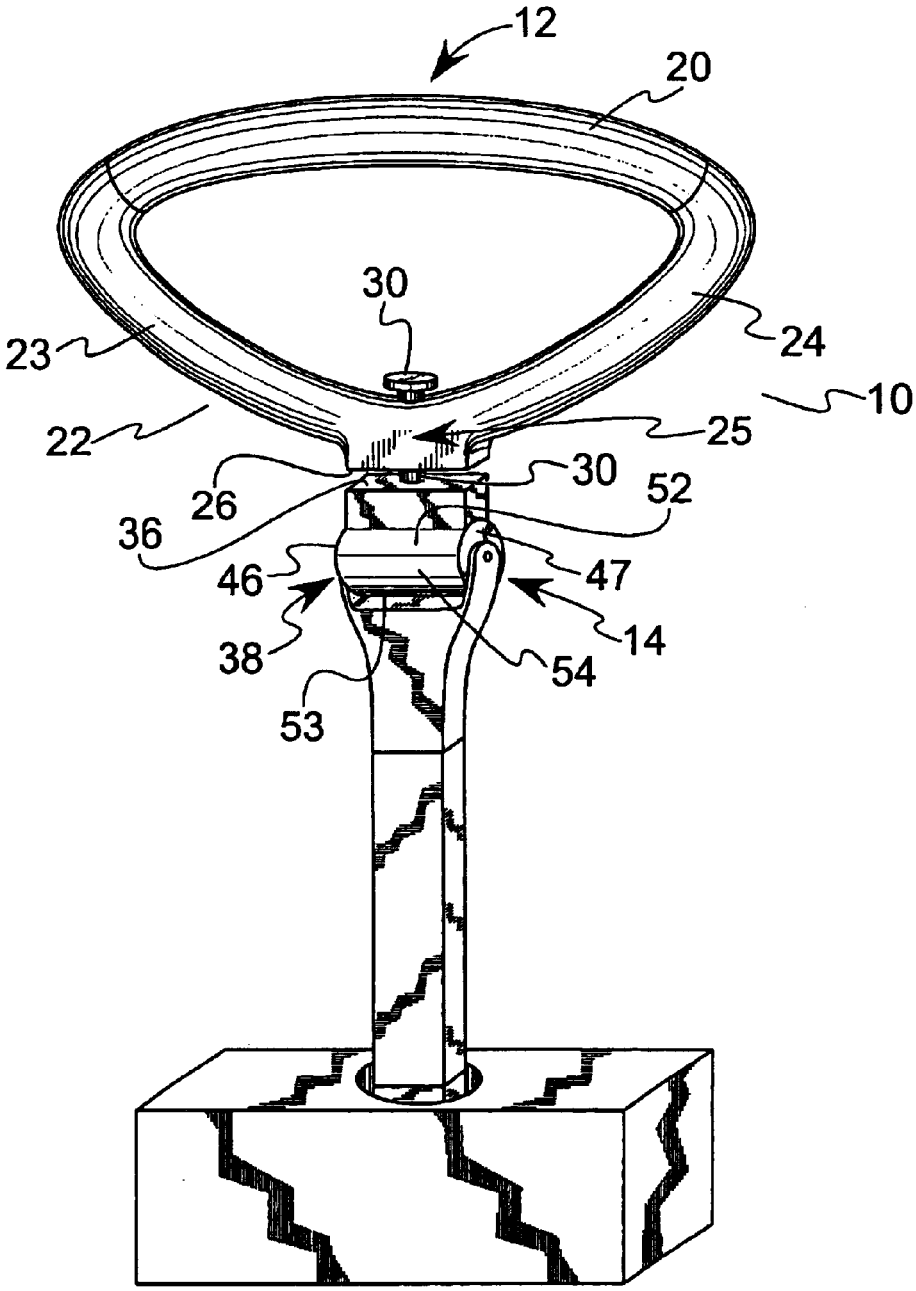
FIG. 1 is a perspective view of a universally rotating pivotal luggage handle made in accordance with the present invention and shown operationally secured to a piece of luggage.
Figure 2:
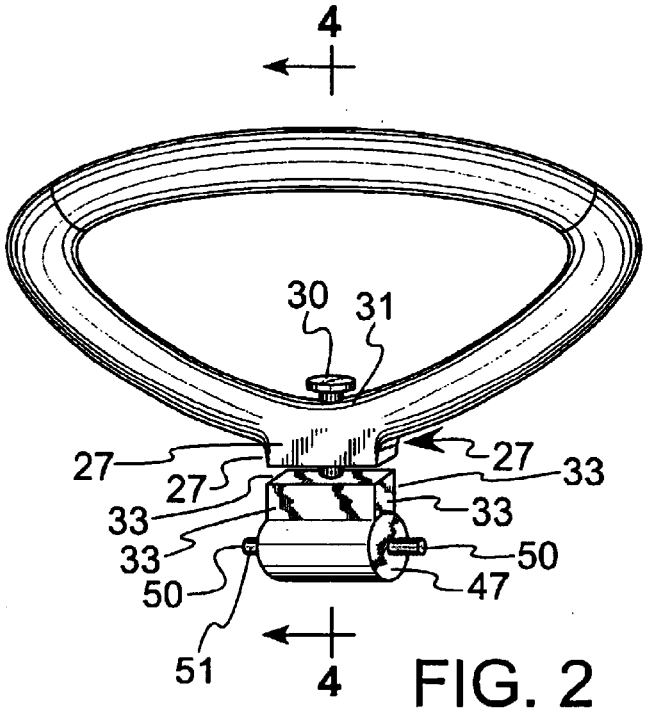
FIG. 2 is a perspective view of just the handle.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Having reference to the drawings, attention is directed first to FIG. 1, which discloses a universally rotating pivotal integral luggage handle made in accordance with the invention designated generally by the numeral 10. The handle can be fabricated from a variety of materials known in the manufacture of handles, such as plastic, metal or a combination thereof. Preferably, at least some degree of molding is utilized in the fabrication of the handle.

The handle of this invention can be appreciated as being generally comprised of a grasping portion 12 and a luggage attachment portion 14. The grasping portion 12 includes a hand contacting portion 20 located at the top of the grasping portion. The hand contacting portion can be either hard or slightly padded. It will also be appreciated from the drawing that it has some curvature associated therewith.

The grasping portion 12 also has a base portion 22 having a first leg 23, a second leg 24, and a center section 25. The first leg and second leg, 23 and 24 respectively, connect the hand contacting portion 20 and the center section 25. The portion of each leg near the juncture with the hand contacting portion features a rounded corner.

As can be appreciated from a comparison of FIGS. 1–4, the center section 25 preferably has a planar bottom surface 26. The center section also has a side wall, although in the specific center section shown in the drawings, there are four actual side walls. It should be appreciated that from a design standpoint, the configuration of the center section could vary, hence for example it could be formed with a single curved surface.

A channel 28 is shown as being formed in the center section 25, which vertical channel at least extends downwardly through at least a portion of the center section and exits through the bottom surface 26. In the preferred embodiment shown in FIGS. 1–4, the channel also extends through the top 31 of the center section 25. A first fastening means 30 passes through the channel 28.

Turning now to the luggage attachment portion 14, it will be appreciated that it comprises an upper portion 32 and a lower portion 38. The upper portion has side walls 33, a channel 34 and a top surface 36, which in the preferred embodiment of the invention is planar. Although in the specific upper portion 32 shown in the drawings, there are four actual side walls, it should be appreciated that from a design standpoint, the configuration of the upper portion 32 could vary, hence for example it could be formed with a side wall of a single curved surface. Furthermore, its horizontal, cross-sectional shape would most likely be similar to that of the center section.

Channel 34 is shown as being formed in the upper portion 32, which vertical channel at least extends upwardly through at least a portion of the upper portion and exits through the top surface 36. In the preferred embodiment shown in FIGS. 1–4, the channel 34 terminates in the luggage attachment portion 14. The upper portion top surface 36 and center section bottom surface 26 are both preferably planar, and preferably are parallel to one another. In fact, they are shown as being coextensive to one another.

The first fastening means 30 is shown as extending into the channel 34. While the type of fastening means is shown as being a grommet, other types of fastening means which would accomplish the same purpose could be utilized, namely, to permit the grasping portion 12 to rotate relative to the luggage attachment portion 14.

The lower portion 38 of the luggage attachment portion 14 has end portions or end walls 46 and 47. Extending outwardly from each end portion, preferably in a horizontal plane are second fastening means 50. The second fastening means 50 are shown as being rod-shaped, although other configurations such as a nub, or other suitable shapes for insertion into the upper terminus of a retractable frame member F of a piece of luggage L for retention therein could be used.

In the embodiment shown, the second fastening means 50 has a rounded side wall 51. The lower portion 38 also is shown in FIGS. 1–4 as having a top surface 52, a bottom surface 53, and a side wall 54, which in the drawings is shown as preferably being curved.

Figure 5:
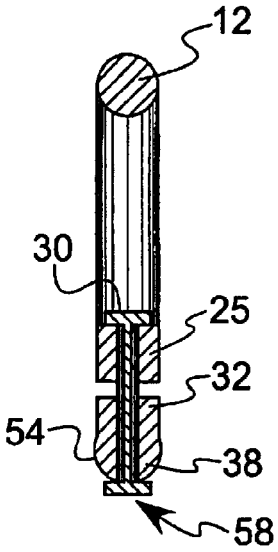
FIG. 5 is a vertical sectional view similar to FIG. 4, but disclosing a modified embodiment of the invention.
Figure 3:
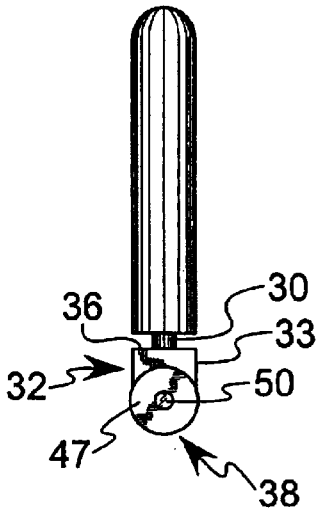
FIG. 3 is a side elevational view taken from the right side of FIG. 2.
Figure 4:
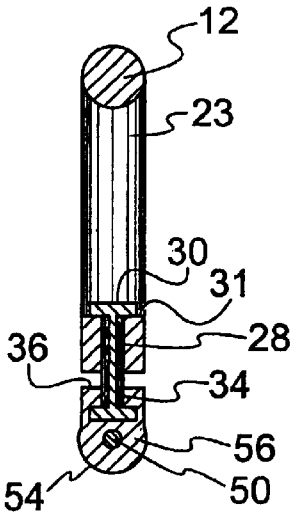
FIG. 4 is a vertical sectional view taken along line 4—4 of FIG. 2.

A comparison of FIGS. 4 and 5 disclose that the invention can be made with an internal terminus 56 of the lower end of the first fastening means, or with an external terminus 58. If the latter embodiment is selected, it should be readily apparent that the channel 34 extends between the center section top 31 and the lower portion bottom 54, such that in the case of a grommet, its top end is located about the center section top, while its bottom end is located below the lower portion bottom as shown in FIG. 5.

Figure 6:
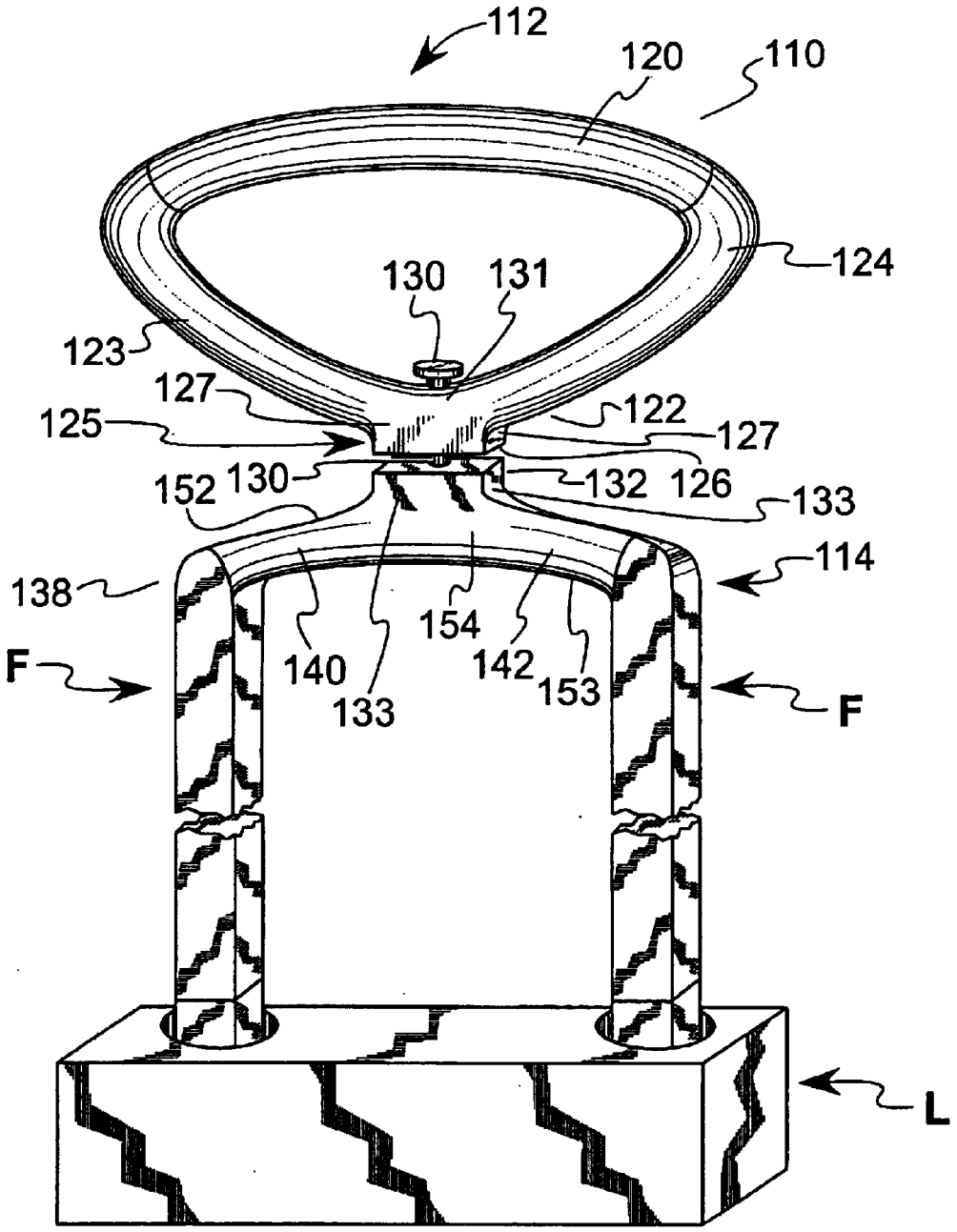
FIG. 6 is a perspective view of a further embodiment of a universally rotating pivotal luggage handle made in accordance with the present invention and shown operationally secured to a piece of luggage.
Figure 7:
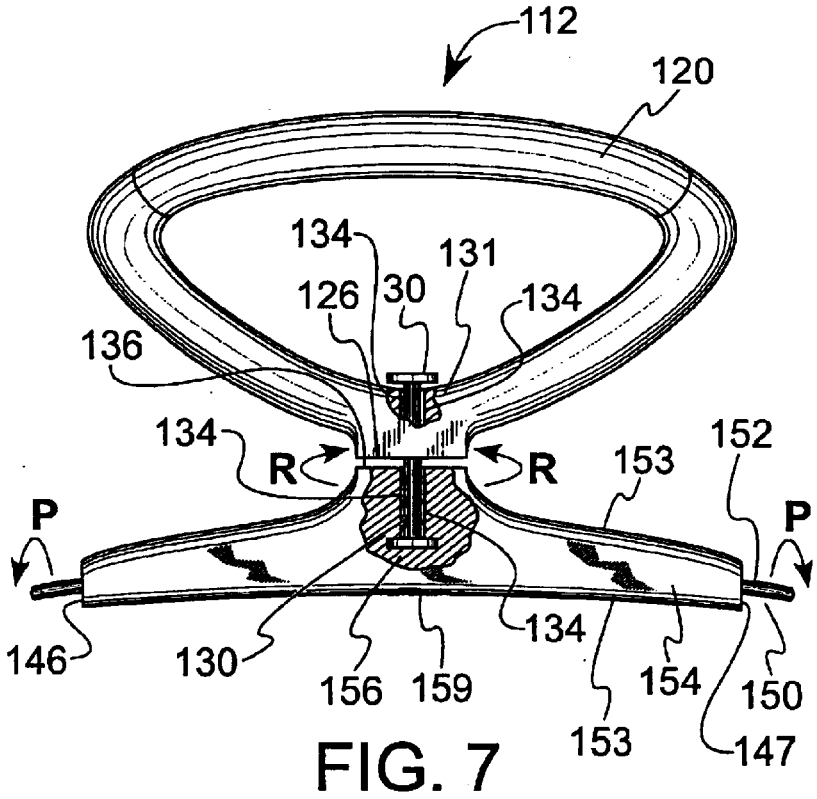
FIG. 7 is a partially exploded front elevational view of just the handle of FIG. 6.

Turning now to a comparison of FIGS. 6–9, further modified embodiments are shown. In FIGS. 6–7, the handle 110 is shown as having a grasping portion 112 and a luggage attachment portion 114. The grasping portion 112 includes a hand contacting portion 120 located at the top of the grasping portion. The hand contacting portion 120 can be either hard or slightly padded. It will also be appreciated from the drawing that it has some curvature associated therewith.

The grasping portion 112 also has a base portion 122 having a first leg 123, a second leg 124, and a center section 125. The first leg and second leg, 123 and 124 respectively, connect the hand contacting portion 120 and the center section 125. The portion of each leg near the juncture with the hand contacting portion features a rounded corner.

As can be appreciated from a comparison of FIGS. 6–7, the center section 125 preferably has a planar bottom surface 126. The center section also has a side wall, although in the specific center section shown in the drawings, there are four actual side walls. Once again, it should be appreciated that from a design standpoint, the configuration of the center section could vary, hence for example it could be formed with a single curved surface.

Channel 134 is shown as being formed in the upper portion 132, which vertical channel at least extends upwardly through at least a portion of the upper portion and exits through the top surface 136. In the embodiment shown in FIGS. 6–7, the channel 134 terminates in the luggage attachment portion 114. The upper portion top surface 136 and center section bottom surface 126 are both preferably planar, and preferably are parallel to one another. In fact, they are shown as being coextensive to one another.

The first fastening means 130 is shown as extending into the channel 134. While the type of fastening means is shown as being a grommet, other types of fastening means which would accomplish the same purpose could be utilized, namely, to permit the grasping portion 112 to rotate relative to the luggage attachment portion 114.

The lower portion 138 of the luggage attachment portion 114 has a first leg 140 and a second leg 142 which extend outwardly along the same elongated axis in a generally horizontal plane. At the outer terminus of each leg 140 and 142 are end portions or end walls 146 and 147 respectively. Extending outwardly from each end portion, preferably in a horizontal plane are second fastening means 150. The second fastening means 150 are shown as being rod-shaped, although other configurations such as a nub, or other suitable shapes for insertion into the upper terminus of a retractable frame member F of a piece of luggage L for retention therein could be used.

In the embodiment shown, the second fastening means 150 has a rounded side wall 151. The lower portion 138 also is shown in FIGS. 6–7 as having a top surface 152 shown are being rounded, a bottom surface 153 shown as being substantially planar, and a side wall 154 shown as preferably being curved.

Figure 8:
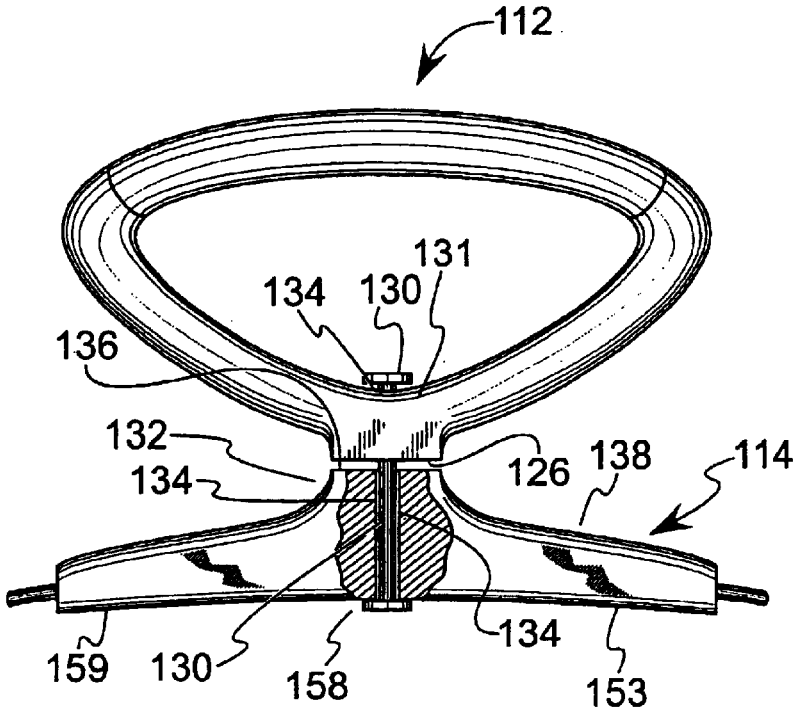
FIG. 8 is a partially exploded front elevational view similar to FIG. 7, but disclosing yet another modified embodiment of the invention.

A comparison of FIGS. 7 and 8 disclose that the invention can be made with an internal terminus 156 of the lower end of the first fastening means, or with an external terminus 158. If the latter embodiment is selected, it should be readily apparent that the channel 134 extends between the center section top 131 and the lower portion bottom 154, such that in the case of a grommet, its top end is located about the center section top, while its bottom end is located below the lower portion bottom as shown in FIG. 8.

Figure 9:
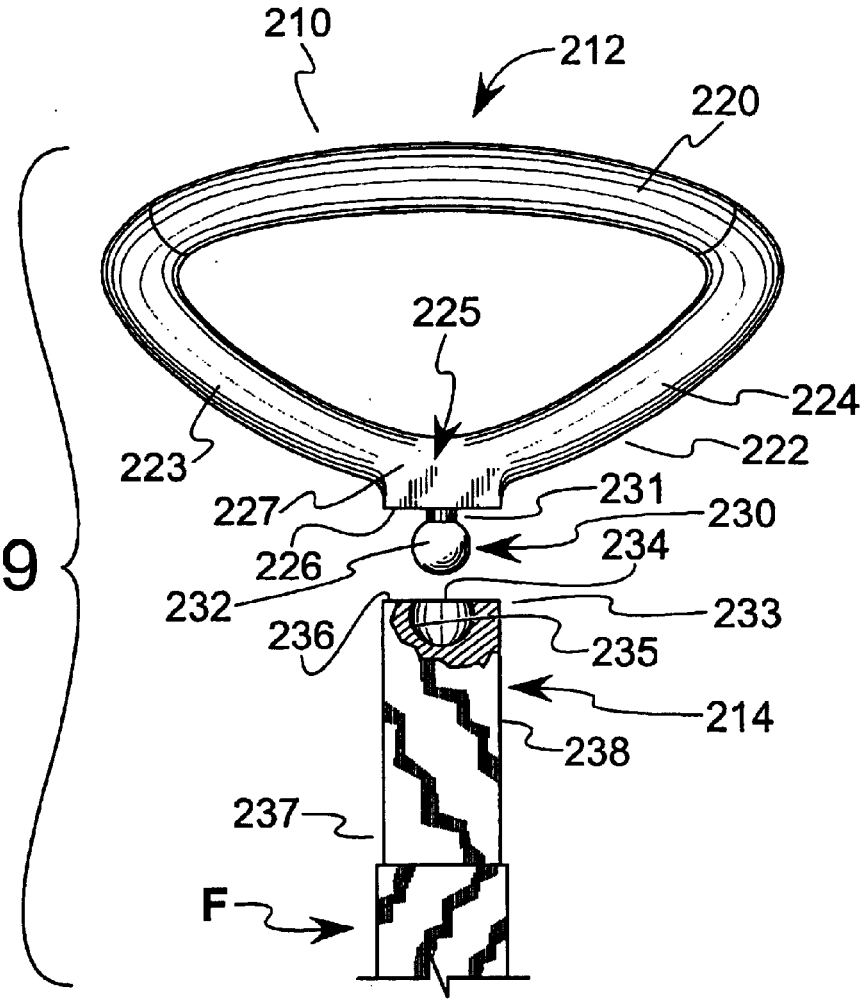
FIG. 9 is a partially exploded front elevational view disclosing yet another modified embodiment of the invention.

Turning now to FIG. 9, there is disclosed handle 210 shown as having a grasping portion 212 and a luggage attachment portion 214. The grasping portion 212 includes a hand contacting portion 220 located at the top of the grasping portion. The hand contacting portion 220 can be either hard or slightly padded. It will also be appreciated from the drawing that it has some curvature associated therewith.

The grasping portion 212 also has a base portion 222 having a first leg 223, a second leg 224, and a center section 225. The first leg and second leg, 223 and 224 respectively, connect the hand contacting portion 220 and the center section 225. The portion of each leg near the juncture with the hand contacting portion is shown as having a rounded corner.

As can be appreciated from FIG. 9, the center section 225 preferably has a planar bottom surface 226. The center section also has a side wall 227. Once again, it should be appreciated that from a design standpoint, the cross-sectional configuration of the center section 225 could vary.

Extending downwardly from the bottom surface 226 is fastening means 230, which in FIG. 9 is shown as being a ball joint. A connector 231 is disposed intermediate the bottom surface 226 and the exterior surface 232 of the fastening means 230, which exterior surface is shown as being substantially spherical. The connector is of a cross-sectional dimension less than that associated with the fastening means 230 so as to facilitate the pivotal rotation of the luggage attachment portion relative to the grasping portion.

The luggage attachment portion 214 has an upper portion 233 and a lower portion 237. The upper portion has a top surface 236 which may be planar or coextensive with the bottom surface of the grasping portion. An aperture 234 in the top surface 236 provides access to a recess 235, the dimensions of which recess can accommodate the fastening means, yet the comparative dimensions of the aperture to the fastening means provides for the securing of the grasping portion to the luggage attachment portion.

The luggage attachment portion has a sidewall 238. The lower portion 237 is secured to the luggage handle frame F. As shown in FIG. 9, the luggage attachment portion is integral the handle frame, being secured thereto by telescoping in a manner well known in the art.

Thus, the universally rotating pivotal integral handle of this invention can be incorporated into the design of existing models of luggage with retractable handle frames, whether of a single frame member type as shown in FIGS. 1–5, or the type with two parallel cooperating frame members as shown in FIG. 6–8, or the type with a single frame member as shown in FIG. 9. The integral handle of the invention permits a piece of luggage to easily change directions.

While the form of apparatus herein described constitutes a preferred embodiment of the present invention, it is to be understood that the invention is not limited to this precise form of apparatus and that changes may be made therein without departing from the scope of the invention which is defined in the appended claims.

What is claimed is:

1. A universally rotatable pivotal integral luggage handle for use with a piece of luggage having a retractable handle frame, said handle comprising a grasping portion, said grasping portion comprising a hand contacting portion and a base portion, said base portion having a first leg, a second leg, and a center section, said center section having a sidewall and a bottom surface, said center section located between said first and second legs, said center section having a vertical channel exiting at least from said bottom surface, and a luggage attachment portion, said luggage attachment portion comprising an upper portion and a lower portion, said upper portion having a sidewall and a top surface, said luggage attachment portion having a vertical channel exiting at least from said top surface, said grasping portion and said luggage attachment portion connected by fastening means, said fastening means extending vertically through said respective channels in said center section and said luggage attachment portion, said grasping portion and said luggage attachment portion being rotatably secured together, said lower portion comprising a pair of end portions with a second fastening means projecting horizontally outwardly from each of said end portions, said pair of second fastening means connected to the retractable handle frame.

2. The luggage handle according to claim 1 wherein said center section has a top surface, said vertical channel exiting from said center section top surface.

3. The luggage handle according to claim 1 wherein said luggage attachment portion has a bottom surface, said vertical channel of said attachment portion exiting from said luggage attachment portion bottom surface.

4. The luggage handle according to claim 1 wherein said lower portion has a rounded side wall.

5. The luggage handle according to claim 1 wherein said second fastening means provides for pivotal connection of said luggage attachment portion to the handle frame.

6. The luggage handle according to claim 1 wherein said bottom surface of said center section is planar, and said top surface of said upper portion of said luggage attachment portion is planar, said bottom surface and said top surface being parallel to one another.

7. The luggage handle according to claim 6 wherein said bottom surface and said top surface are coextensive to one another.

8. The luggage handle according to claim 1 wherein said lower portion comprises a first leg and a second leg, with each second fastening means projecting horizontally outwardly from a respective leg.

9. The luggage handle according to claim 1 wherein each of said second fastening means are in the same horizontal plane.

10. The luggage handle according to claim 1 wherein said second fastening means are located above the bottom surface of said luggage attachment portion.

11. The luggage handle according to claim 1 wherein said vertical channel of said attachment portion extends between and exits from said bottom surface and said top surface.

12. The luggage handle according to claim 1 wherein said pair of second fastening means is connected to and provides for the pivotal connection of said luggage attachment portion to the retractable handle frame.

13. The luggage handle according to claim 1 wherein said bottom surface of said grasping portion center section and said luggage attachment portion upper portion top surface are coextensive to one another.

14. A universally rotatable pivotal integral luggage handle for use with a piece of luggage having a retractable handle frame, said handle comprising a grasping portion, said grasping portion comprising a hand contacting portion and a base portion, said base portion having a first leg, a second leg, and a center section, said center section having a sidewall, a top surface, and a bottom surface, said center section located between said first and second legs, said center section having a vertical channel exiting from said bottom surface, and a luggage attachment portion, said luggage attachment portion comprising an upper portion and a lower portion, said upper portion having a sidewall and a top surface, said luggage attachment portion having a vertical channel exiting at least from said top surface, said grasping portion and said luggage attachment portion connected by fastening means, said fastening means extending vertically through said respective channels in said center section and said luggage attachment portion, said grasping portion and said luggage attachment portion being rotatably secured together, said lower portion comprising a first leg and a second leg, each leg disposed in a generally horizontal plane and having a pair of end portions with a second fastening means projecting horizontally outwardly from each of said end portions, said pair of second fastening means connected to and providing for the pivotal connection of said luggage attachment portion to the retractable handle frame.

15. The luggage handle according to claim 14 wherein each of said second fastening means are in the same horizontal plane.

16. The luggage handle according to claim 14 wherein said second fastening means are located above the bottom surface of said luggage attachment portion.

17. A universally rotatable pivotal integral luggage handle for use with a piece of luggage having a retractable handle frame, said handle comprising a grasping portion, said grasping portion comprising a hand contacting portion and a base portion, said base portion having a first leg, a second leg, and a center section, said center section having a sidewall, and a bottom surface, said center section located between said first and second legs, said center section having a bottom surface and a vertically disposed fastening means extending downwardly below said bottom surface, and a luggage attachment portion, said luggage attachment portion having a sidewall and a top surface, said luggage attachment portion having a recessed portion, said grasping portion and said luggage attachment portion being rotatably secured together by said fastening means and said recessed portion.

18. The luggage handle according to claim 17 wherein said luggage attachment portion is secured to the retractable handle frame.

19. The luggage handle according to claim 17 wherein said fastening means is a ball joint, said ball joint being spaced a distance below said bottom surface.

20. The luggage handle according to claim 19 wherein said grasping portion includes a connector between said ball joint and said bottom surface.

* * * * *